US009805698B1

(12) United States Patent
Nackard

(10) Patent No.: US 9,805,698 B1
(45) Date of Patent: Oct. 31, 2017

(54) TRUSS ROD TENSIONING MECHANISM

(71) Applicant: Kevin Jason Nackard, Flagstaff, AZ (US)

(72) Inventor: Kevin Jason Nackard, Flagstaff, AZ (US)

( * ) Notice: Subject to any disclaimer, the term of this patent is extended or adjusted under 35 U.S.C. 154(b) by 0 days.

(21) Appl. No.: 15/423,518

(22) Filed: Feb. 2, 2017

Related U.S. Application Data

(60) Provisional application No. 62/290,705, filed on Feb. 3, 2016.

(51) Int. Cl.
*G10D 3/06* (2006.01)
*G10D 1/08* (2006.01)

(52) U.S. Cl.
CPC ..... *G10D 3/06* (2013.01); *G10D 1/08* (2013.01)

(58) Field of Classification Search
CPC ..... G10D 1/08
See application file for complete search history.

(56) References Cited

U.S. PATENT DOCUMENTS

| | | | | |
|---|---|---|---|---|
| 1,912,106 | A | 5/1933 | Turturro | |
| 3,244,054 | A | 4/1966 | Berglund | |
| 4,172,404 | A | 10/1979 | Dopyera | |
| 4,508,003 | A | 4/1985 | Smakula | |
| 4,953,435 | A | 9/1990 | Chapman | |
| 5,305,819 | A | 4/1994 | Boulanger | |
| 5,458,035 | A | 10/1995 | Okamura | |
| 5,864,073 | A | 1/1999 | Carlson | |
| 6,265,648 | B1 | 7/2001 | Steinberger | |
| 6,593,515 | B2 | 7/2003 | Hirayama et al. | |
| 6,884,932 | B2 | 4/2005 | Wrona | |
| 7,838,750 | B2 | 11/2010 | Steinberger | |
| 8,183,447 | B1 | 5/2012 | Chapman | |
| 9,053,684 | B2 | 6/2015 | Johnson | |
| 9,368,092 | B2 | 6/2016 | Hooker | |
| 2008/0121086 | A1* | 5/2008 | Else | G10D 3/06 84/293 |

* cited by examiner

*Primary Examiner* — Kimberly Lockett
(74) *Attorney, Agent, or Firm* — Invention To Patent Services; Alex Hobson

(57) ABSTRACT

A stringed musical instrument has a neck having a truss rod embedded therein and a tensioning mechanism to adjust the tension of the truss bar. A truss rod is typically seated at the peghead and extends within the neck to the body of the stringed instrument. A tension adjustment mechanism may incorporate a slide assembly having a ramp that engages with an actuating screw that is accessible from the front surface of the stringed instrument. Adjustment of the screw changes the tension of the truss bar. A tension adjustment mechanism may incorporate a cam that interfaces with an actuating screw, wherein the cam interfaces with the truss bar to adjust tension.

19 Claims, 6 Drawing Sheets

TRUSS ROD TENSIONING MECHANISM

CROSS REFERENCE TO RELATED APPLICATIONS

This application claims the benefit of provisional patent application No. 62/290,705 filed on Feb. 3, 2016 and entitled Vertical Adjust Truss Rod; the entirety of which is incorporated herein by reference

BACKGROUND OF THE INVENTION

Field of the Invention

The present invention relates to stringed musical instruments having a truss rod for adjusting the curvature of the neck and compensating for bowing of a neck due to string tension.

Background

Modern guitars consist principally of a body, a neck and a peghead. The neck extends from the body to the peghead. Guitar strings extend from the peghead to the body and are under tension when in tune. The guitar strings extend above the top surface of the neck and body and, when tensioned to pitch, exert a force that has a tendency to bow the neck in a concave manner in relation to the top surface of the neck.

To offset this tendency of the neck to bow, a metal rod that is bent into a concave shape is frequently embedded within the neck. One end of the metal rod is restrained within the neck, typically by a 90 degree hook, and the other end typically is threaded with a nut. The length of the truss rod is typically covered with plastic that prevents it from sticking to the wood when being glued in place. When the nut is tightened against the neck wood, the tension in the truss rod acts to counter the force exerted by the strings to prevent bowing of the guitar neck.

The adjustment of the curvature of the neck is made by tightening or loosening the nut at the threaded end of the truss rod against the wood of the neck. Many truss rods function only in one direction to offset the bow in the neck that occurs from the tension of the strings. However, it is desirable to have a slight concave bow in the neck in order to prevent strings from buzzing on the frets when the action (distance between the fret and string) is low. If the string tension is not sufficient to provide this slight concave bow, then some guitars have two-way truss rods that allow this bow to be produced. There are many designs for two-way truss rods, but most employ two metal rods (instead of one) interacting against each other. These designs usually require a deeper truss rod channel but are adjusted in a similar manner to a one-way truss rod.

The truss rod nut can be located at either the peghead end or the body end of the guitar neck. Since the truss rod is embedded in the neck, a slot or notch must be cut into the peghead or the body to access the truss rod nut. Because the strings also run generally in the same direction as the truss rod, maneuvering a wrench through the slot, into the truss rod nut and rotating it can be challenging. When the adjustment is made at the peghead, removing the neck material to access the truss rod nut can weaken the peghead strength making it more prone to breaking if dropped. Truss rod adjustments at the body end are difficult to make because the wrench must be manipulated through the strings or even require the removal of the strings or neck to make the adjustment. This makes correct adjustment difficult.

SUMMARY OF THE INVENTION

An exemplary stringed musical instrument of the present invention comprises a neck having a truss rod embedded therein. In an exemplary embodiment, the truss rod is seated at the peghead end of the neck such that it is rotationally fixed. This may be accomplished by an approximate 90 degree bend in the truss rod end that is secured to a hole in the neck. The length of the truss rod may have a thin plastic coating to prevent glue from adhering to it when the truss rod plug is glued in place during construction.

Typically, a truss rod is embedded into a channel in the neck that is concave in relation to the top, fingerboard, side of the guitar neck. The truss rod is either bent or pressed into the concave channel and a matching wooden plug is glued over the truss rod to permanently embed it in the guitar neck The end of the truss rod near the body, or body-end, may be threaded into the adjustment mechanism. An adjustment mechanism may be embedded in a rectangular hole at the end of the truss rod channel in the guitar neck so that there is little to no movement possible. An exemplary adjustment mechanism has a rectangular housing, a slide, a ramp, a nut and an actuating screw. Adjusting the actuating screw on the top of the housing will increase or decrease the tension in the truss rod. The exemplary invention functions as a two-way truss rod and can place the truss rod in tension or compression.

The housing of the exemplary adjustment mechanism has several apertures that allow for assembly. The slide can move longitudinally along the direction of the truss rod in the housing. Additionally, an aperture perpendicular to the truss rod direction within the housing allows the position of the ramp to be adjusted vertically via the actuating screw.

The slide has a horizontal aperture perpendicular to the truss rod direction in which the nut is seated. The threaded end of the truss rod passes through an aperture in the face of the slide and is threaded into the nut. The nut and truss rod can rotate within the slide plus or minus approximately 10 degrees. This is necessary because the truss rod will likely be seated at a slight angle from the horizontal plane due to it's concave shape.

There is a second aperture in the slide also perpendicular to the truss rod direction. However, this aperture is vertical and is angled approximately 30 degrees from the vertical plane. The ramp slides up and down, at an angle, in this aperture. The ramp has a threaded through hole at an angle of approximately 30 degrees from the vertical plane so that the actuating screw is vertical when assembled. The actuating screw is threaded through this hole and is fixed vertically in the housing block. The actuating screw is longer than the height of the slide and functions as a lead screw to adjust the position of the ramp up or down within the slide. The actuating screw can be rotated but does not move horizontally or vertically with respect to the housing.

When assembled, and embedded in a guitar neck, turning the actuating screw will move the ramp up or down causing the slide to move slightly forward or backward causing the tension in the truss rod to decrease or increase, respectively.

On the top of the neck is attached a fingerboard with (or without) frets. A hole between the frets near the body end of the neck allow for adjustment of the actuating screw in the housing. Alternatively, the adjustment mechanism could be installed rotated 180 degrees about the neck axis so that that the actuating screw is accessible through a hole on the bottom of the neck.

This method of truss rod adjustment requires no removal of cover plates, or hardware and can be simply performed with an Allen key, or Allen wrench, while the instrument is strung to pitch.

A stringed instrument, as used herein is any stringed musical instrument having a neck that extends out from the body and includes, but is not limited to, guitars, bass guitars, and banjo.

The summary of the invention is provided as a general introduction to some of the embodiments of the invention, and is not intended to be limiting.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
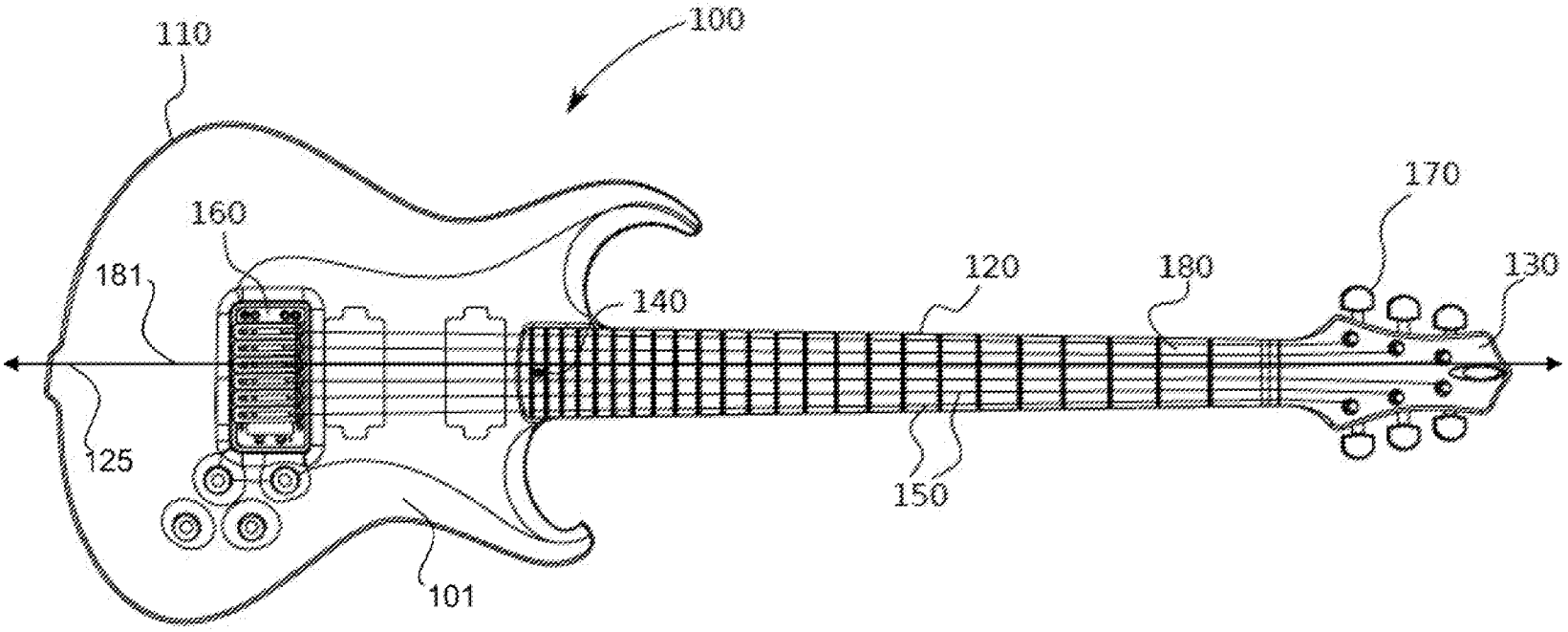
FIG. 1 is a front view of a guitar incorporating an exemplary truss rod and adjustment mechanism. The truss rod adjustment screw is visible between the 23rd and $24^{th}$ frets.

The summary of the invention is provided as a general introduction to some of the embodiments of the invention, and is not intended to be limiting.

DETAILED DESCRIPTION OF THE ILLUSTRATED EMBODIMENTS

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale and some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for the purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary electric guitar, an example of a stringed instrument 100, comprises a body 110 with a neck 120 extending from it to a peghead 130 along a neck axis 125. Fingerboard 180 is attached to the top of neck 120 and the fingerboard plane 181 is a plane that is flush with the fingerboard. A truss rod adjusting hole 140 is located in the fingerboard 180 near the body 110 and allows for neck curvature adjustment. Instrument strings 150 are attached at one end to the back of the body 110 and extend through the bridge mechanism 160 and across the guitar neck 120 and fingerboard 180 where they are attached to tuning mechanisms 170 on peghead 130. The front or front surface 101 of the electric guitar is shown.

Figure 2:
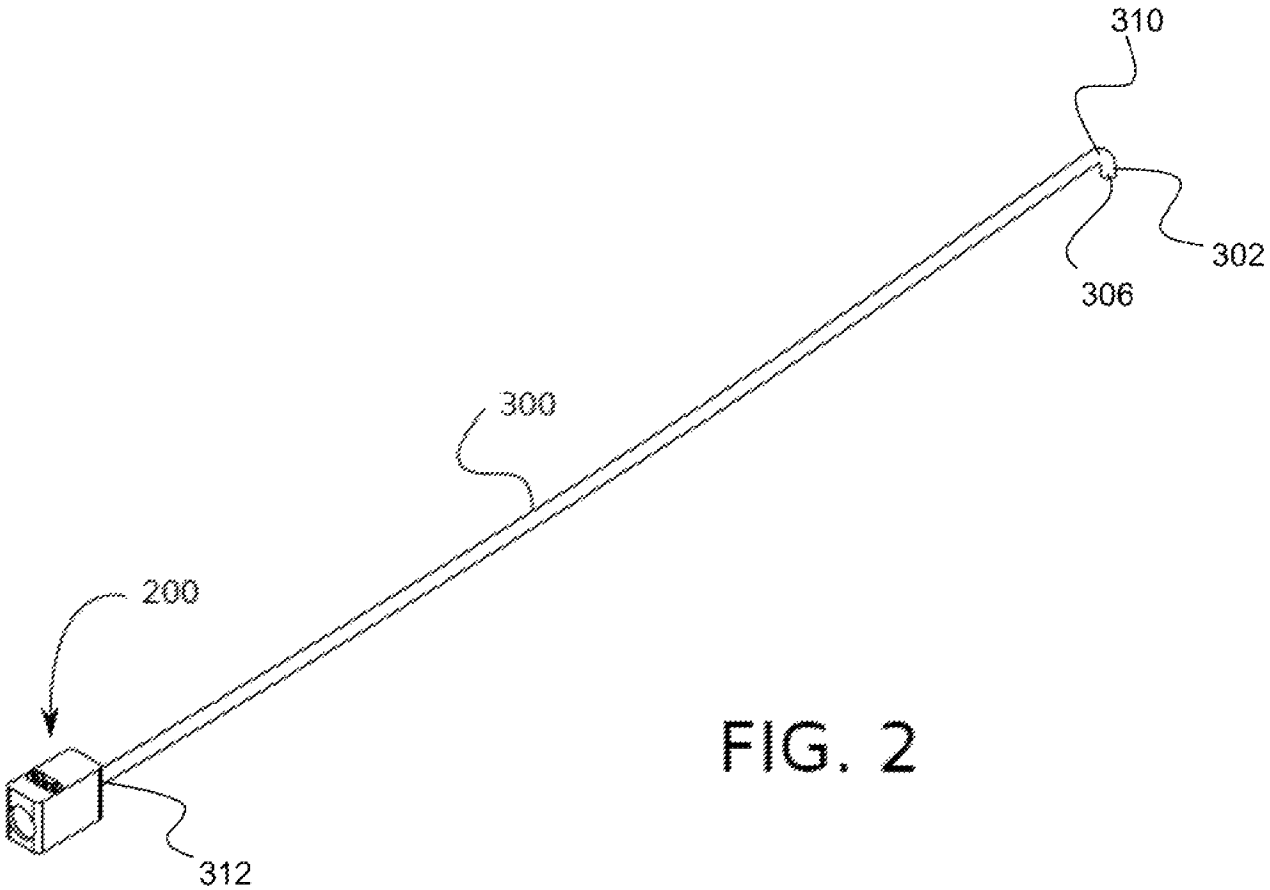
FIG. 2 is a front perspective view of an exemplary truss rod and adjustment mechanism.

FIG. 2 is a front perspective of an exemplary truss rod 300 and adjustment mechanism 200. The truss rod has a peghead end 310 that has an attachment feature 306, a curved end 302, for attachment to the peghead and a body end 312 for engagement with the adjustment mechanism 200.

Figure 3:
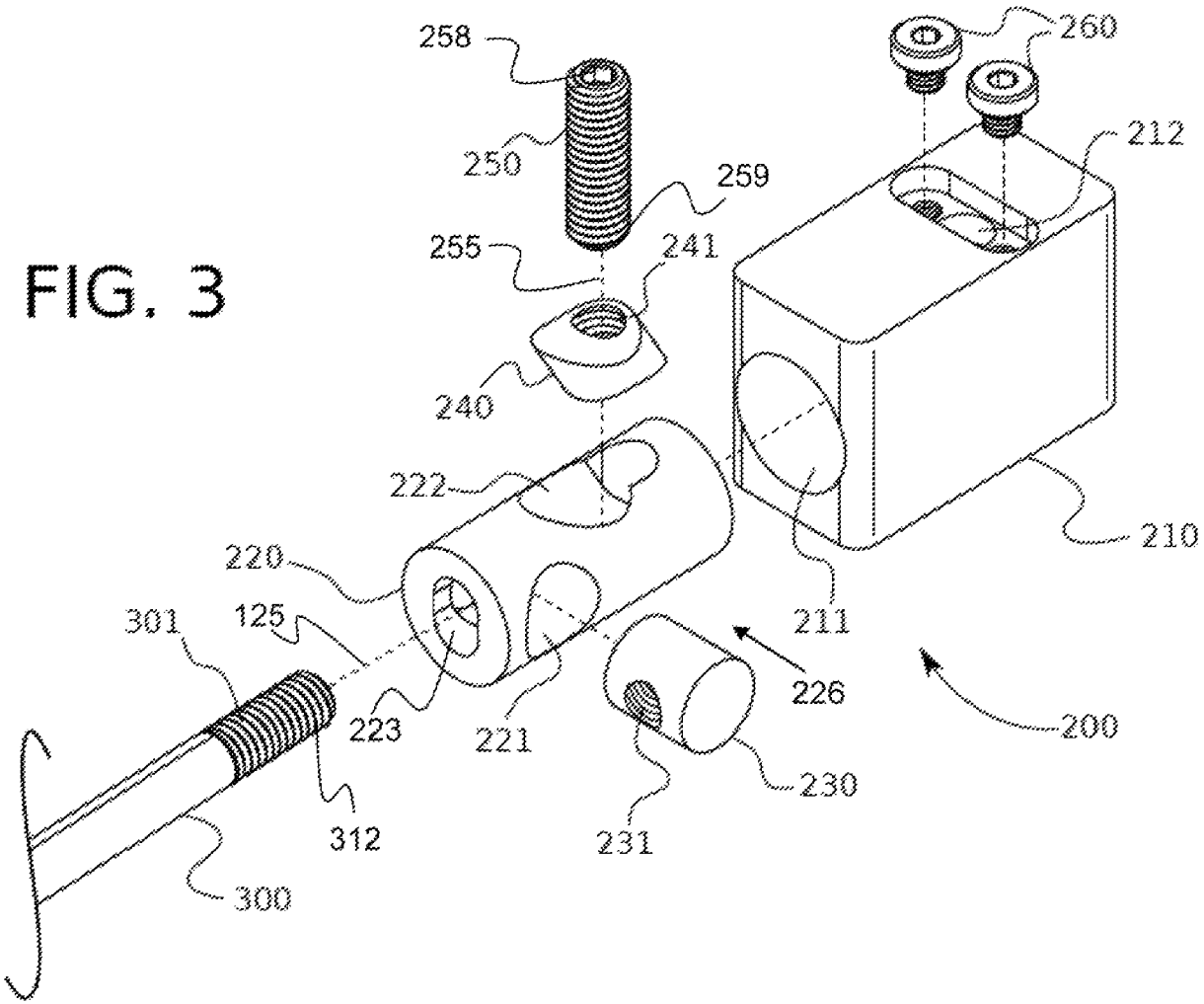
FIG. 3 is a perspective exploded view of an exemplary truss rod and tension adjustment mechanism employing a slide.

FIG. 3 shows exemplary truss rod 300 and adjustment mechanism 200 comprising a slide assembly 226. The body end 312 of the truss rod has threads for engagement with the adjustment mechanism. The adjustment mechanism 200 includes housing 210, slide assembly 226 comprising a slide 220, nut 230, ramp 240, actuating screw 250. Retaining screws 260 secure the slide assembly to the housing. To assemble, the nut 230 slides into the slide aperture 221 of slide 220. The body end 312 of the truss rod is then inserted into rod aperture 223 of the slide and then the threads 301 are threaded into hole 231 of nut 230. The length of the assembly can be adjusted to the required length by threading truss rod 300 into nut 230. The ramp 240 is then inserted into the ramp aperture 222 of slide 220. The assembly of truss rod 300, slide 200, nut 230 and ramp 240 can then be inserted into assembly aperture 211 of housing 210. The actuating screw 250 can then be inserted through actuator aperture 212 of housing 210 and threaded into hole 241 of ramp 240. The actuating screw has an interface end 258 and an insert end 259. The screws 260 retain the actuating screw 250 in position in the housing 210. For example, truss rod 300 and adjustment mechanism 200 may be made of metal or any material of sufficient strength.

Figure 4:
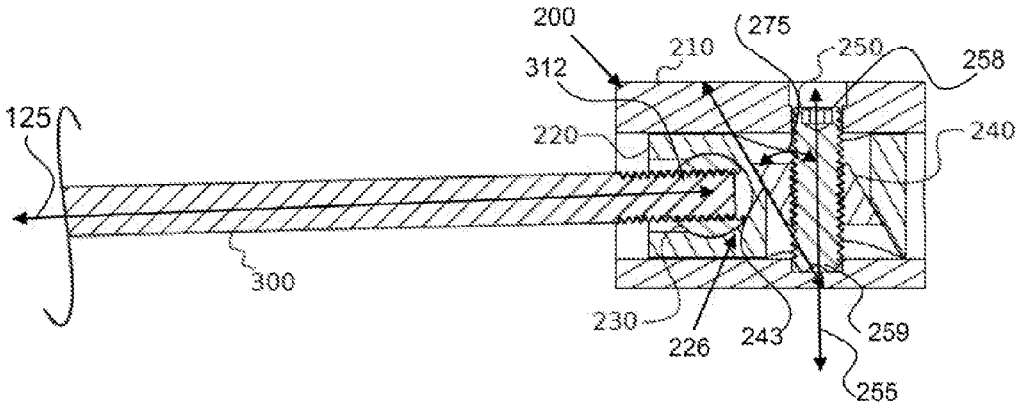
FIG. 4 is a cutaway view of an exemplary truss rod and adjustment mechanism employing a slide.

FIG. 4 shows a cutaway view of truss rod 300 and adjustment mechanism 200. When the actuating screw 250 is rotated in housing 210, the ramp 240 will move up or down causing slide 220 to move longitudinally within the housing 210. The ramp 240 has an interface surface 243 that is at an offset angle 275 from the actuating screw axis 255 and this interface surface pushes on slide 220 coupled to nut 230 to cause the truss rod to move back and forth along the neck axis to change the tension in the truss rod. Truss rod 300 can be put in tension or compression, depending which way actuating screw 250 is rotated.

Figure 5:
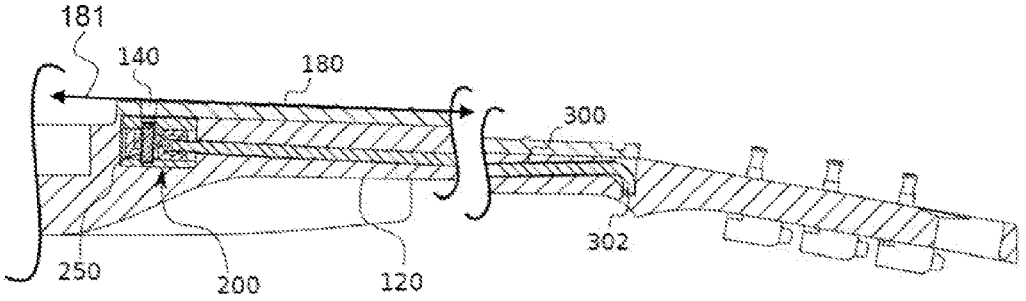
FIG. 5 is a section view of a guitar incorporating an exemplary truss rod and adjustment mechanism employing a slide.

FIG. 5 shows an exemplary truss rod 300 and adjustment mechanism 200 in an exemplary stringed instrument 100. The truss rod 300 is embedded in neck 120. The curved end 302 is anchored in neck 120 to prevent the truss rod from moving rotationally and longitudinally when in tension or compression. The fingerboard 180 is attached to the top of neck 120 and the hole 140 in the fingerboard allows access to actuating screw 250.

Figure 6:
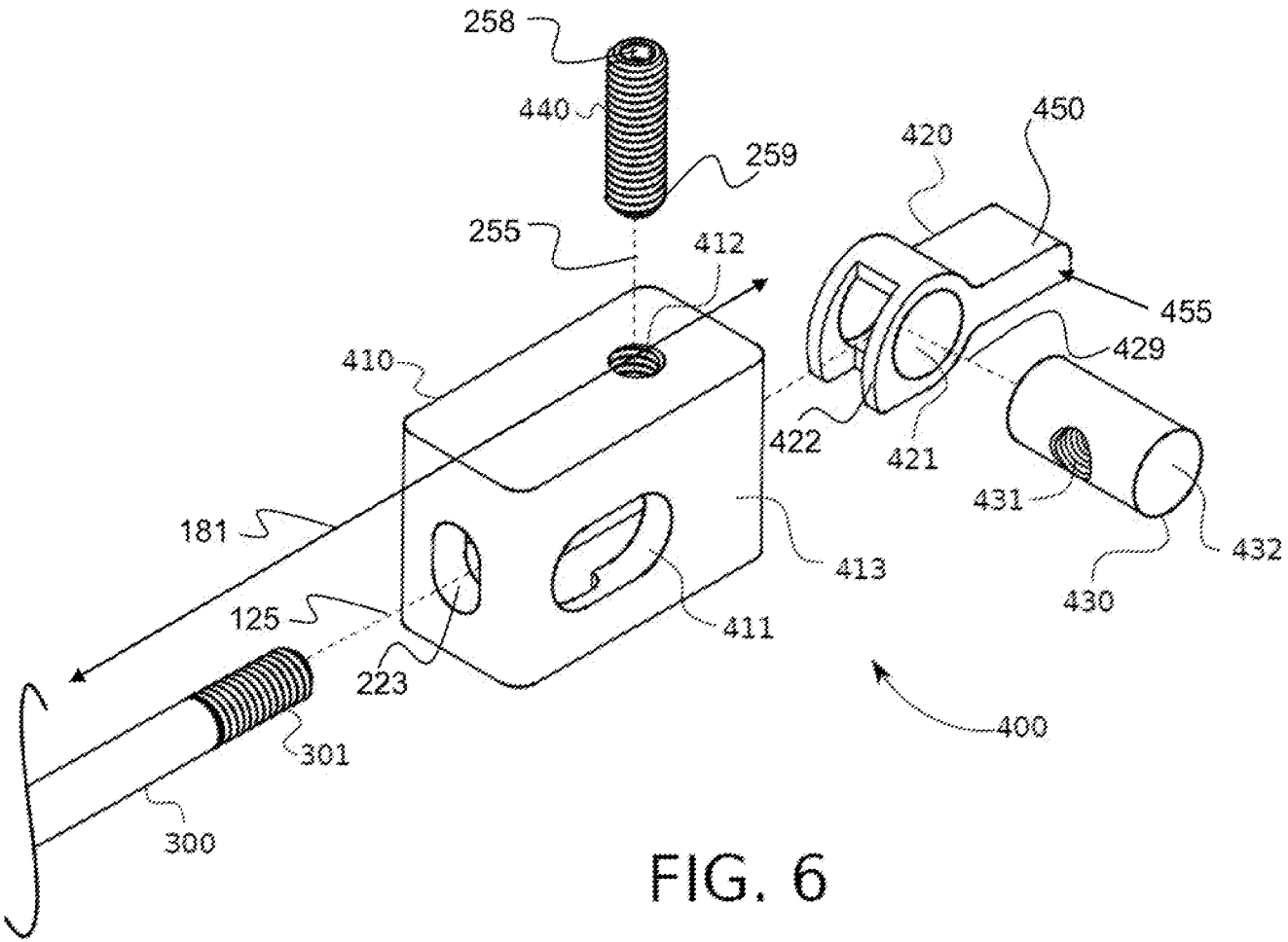
FIG. 6 is a perspective exploded view of an exemplary truss rod and tension adjustment mechanism employing a cam.

FIG. 6 is an exemplary truss rod 300 and cam adjustment mechanism 400 comprising a cam assembly 455. The cam adjustment mechanism 400 includes a housing 410, the cam assembly 455 comprising a cam 420, nut 430 and actuating screw 440. To assemble, the cam 420 is inserted into the housing 410. The cam rotates about cam axis 429. The nut 430 is then inserted through the nut aperture 411 of the housing 410 and the cam aperture 421 of the cam 420. The nut-face 432 of the nut 430 is made flush with the housing-face 413 of the housing 410. The threads 301 on the body end 312 of the truss rod 300 can then be threaded into the threaded hole 431 of the nut 430. The actuating screw 440 is threaded into the screw-hole 412 of the housing 410. The actuating screw has an insert end 449 that interfaces with the cam lever 450 to rotate the cam about the cam axis 460. The rotation of the cam changes the tension of the truss rod. A user may simply insert an Allen wrench into the interface end 448 of the actuating screw and rotate it to change the tension of the truss rod. This can be done without removing or damaging the strings. For example, the truss rod 300 and adjustment mechanism 400 are made of metal or any material of sufficient strength. The cam axis is substantially perpendicular within about 15 degrees or preferably within about 10 degrees of the neck axis 125 and substantially parallel within about 15 degrees and preferably within about 10 degrees of the fingerboard plane 181, which is a plane extending flush with the fingerboard in all directions.

Figure 7:
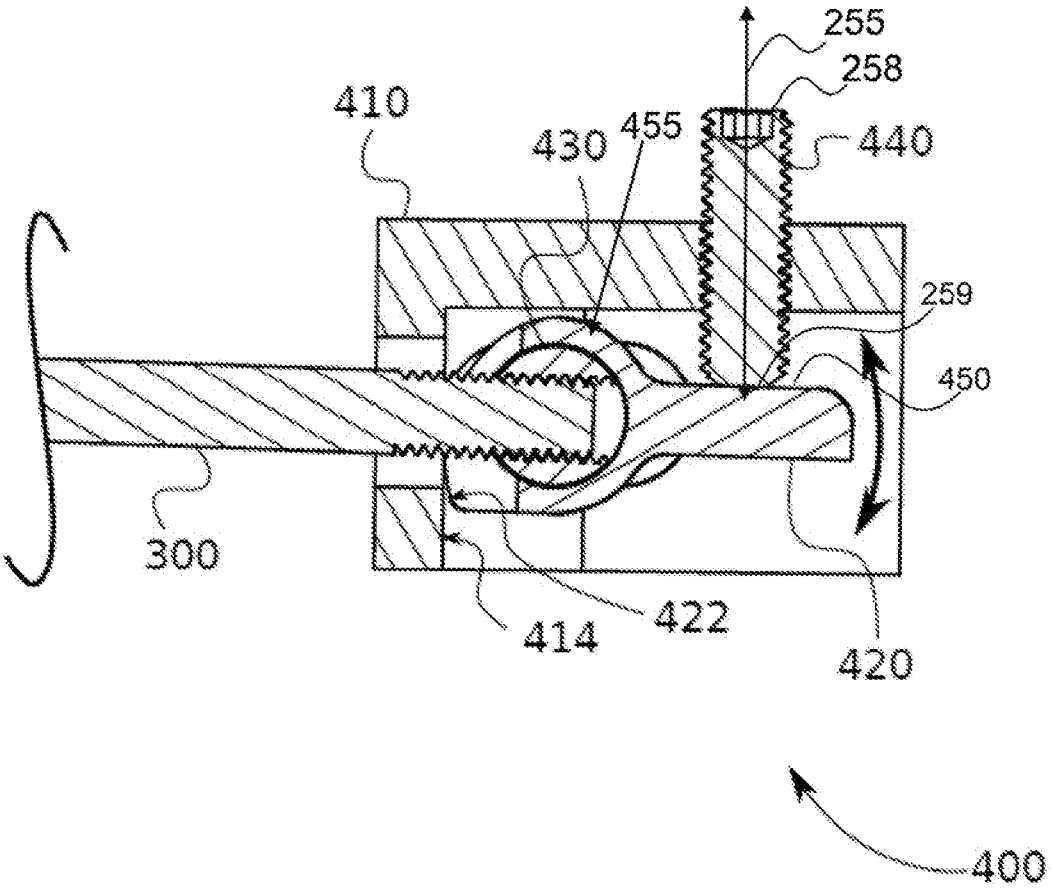
FIG. 7 is a cutaway view of an exemplary truss rod and adjustment mechanism employing a cam.

FIG. 7 FIG. 4 shows a cutaway view of a truss rod 300 and cam adjustment mechanism 400. When the actuating screw 440 is rotated into the housing 410, the insert end 449 of the actuating screw presses on the cam lever 450 of the cam 420 to rotate the cam within the housing. The cam surface 422 of the cam 420 will interact with the housing surface 414 of housing 410 to move the nut 430 longitudinally, or along the neck axis 125, and increase or decrease tension in truss rod 300.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A truss rod tension mechanism for a stringed instrument comprising:

a) a truss rod extending along a neck axis and within said neck of the stringed instrument from a body end to a peg head end;

b) a tension adjustment mechanism configured within the stringed instrument and coupled with the body end of the truss rod and comprising:

i) an adjustment screw having an interface end and an insert end;

ii) a truss rod coupling feature;

wherein an adjustment hole in the stringed instrument enables turning of the adjustment screw and changing of the tension of the truss rod through the truss rod coupling feature; and wherein the truss rod coupling feature comprises a ramp having an interface surface that is coupled with the body end of the truss rod, wherein the ramp is threaded onto the adjustment screw and wherein rotation of the adjustment screw moves the ramp to chance a tension of the truss rod.

2. The truss rod tension mechanism for a stringed instrument of claim 1, wherein the stringed instrument is a guitar.

3. The truss rod tension mechanism for a stringed instrument of claim 1, wherein the interface surface of the ramp interfaces with a slide assembly comprising a slide and wherein the body end of the truss rod is coupled to the slide assembly.

4. The truss rod tension mechanism for a stringed instrument of claim 3, wherein body end of the truss rod is threaded into the slide assembly.

5. The truss rod tension mechanism for a stringed instrument of claim 3, wherein the ramp is configured within the slide.

6. The truss rod tension mechanism for a stringed instrument of claim 4, wherein the slide assembly comprises a nut that is coupled with the slide assembly and wherein the body end of the truss rod is threaded into the nut.

7. The truss rod tension mechanism for a stringed instrument of claim 6, wherein the nut is detachably attachable to the slide assembly.

8. The truss rod tension mechanism for a stringed instrument of claim 7, wherein the nut is configured in a nut-aperture of the slide.

9. The truss rod tension mechanism for a stringed instrument of claim 4, wherein the slide is configured within a housing and wherein the adjustment screw extends through an actuator aperture in the housing and into the slide assembly, and wherein the slide of the slide assembly moves along the neck axis of the stringed instrument when the adjustment screw is rotated.

10. The truss rod tension mechanism for a stringed instrument of claim 1, wherein the adjustment hole in the body or neck of stringed instrument is on a front surface of the stringed instrument.

11. A truss rod tension mechanism for a stringed instrument comprising:

a) a truss rod extending along a neck axis and within said neck of the stringed instrument from a body end to a peg head end;

b) a tension adjustment mechanism configured within the stringed instrument and coupled with the body end of the truss rod and comprising:

i) an adjustment screw having an interface end and an insert end;

ii) a truss rod coupling feature;

wherein an adjustment hole in the stringed instrument enables turning of the adjustment screw and changing of the tension of the truss rod through the truss rod coupling feature;

wherein the truss rod coupling feature comprises a cam assembly that is coupled with the body end of the truss rod, wherein the cam engages with the adjustment screw and wherein rotation of the adjustment screw rotates the cam to move the body end of the truss rod along the neck axis to change a tension of the truss rod; and wherein the cam assembly comprises a cam having a cam lever that interfaces with the insert end of the adjustment screw, wherein rotation of the adjustment screw rotates the cam about a cam axis.

12. The truss rod tension mechanism for a stringed instrument of claim 11, wherein the cam axis is perpendicular within 10 degrees of the neck axis and parallel within 10 degrees of a fingerboard plane.

13. The truss rod tension mechanism for a stringed instrument of claim 11, wherein body end of the truss rod is threaded into the cam assembly.

14. The truss rod tension mechanism for a stringed instrument of claim 11, wherein the cam assembly comprises a nut that is coupled with the cam assembly and wherein the body end of the truss rod is threaded into the nut.

15. The truss rod tension mechanism for a stringed instrument of claim 14, wherein the nut is detachably attachable to the cam assembly.

16. The truss rod tension mechanism for a stringed instrument of claim 15, wherein the nut is configured in a nut-aperture of cam.

17. The truss rod tension mechanism for a stringed instrument of claim 11, wherein the cam is configured within a housing and wherein the adjustment screw extends through an actuator aperture in the housing and into the cam assembly, and wherein the cam of the cam assembly rotates to move the body end of the truss rod along the neck axis.

18. The truss rod tension mechanism for a stringed instrument of claim 11, wherein the cam rotates about a cam surface that interfaces with a housing surface.

19. The truss rod tension mechanism for a stringed instrument of claim 11, wherein the adjustment hole in the stringed instrument is on a front surface of the stringed instrument.

* * * * *